United States Patent [19]

Valo

[11] 4,271,882

[45] Jun. 9, 1981

[54] BLADE FOR A CUTTER FOR A CHIPPER OR SIMILAR WOOD REDUCING MACHINE

[76] Inventor: Antti T. Valo, PL 29, 08101 Lohja 10, Finland

[21] Appl. No.: 39,626

[22] Filed: May 16, 1979

[30] Foreign Application Priority Data

May 22, 1978 [FI] Finland ..... 781609

[51] Int. Cl.[3] ..... B27G 13/08

[52] U.S. Cl. ..... 144/241; 144/218; 241/92; 241/298; 407/113

[58] Field of Search ..... 144/114 R, 115, 172, 144/162 R, 176, 218, 230, 235, 241; 407/113, 117; 241/92, 294, 298

[56] References Cited

U.S. PATENT DOCUMENTS

| | | | |
|---|---|---|---|
| 999,014 | 7/1911 | DeLaney | 144/115 |
| 3,559,705 | 2/1971 | Salzmann, Jr. | 144/162 R |
| 3,568,284 | 3/1971 | Lunden et al. | 407/113 |
| 4,047,670 | 9/1977 | Svensson | 144/176 X |

*Primary Examiner*—W. Donald Bray
*Attorney, Agent, or Firm*—Ladas & Parry

[57] ABSTRACT

A blade for a cutter for a wood reducing machine, said blade being of a star like three-horn cross-sectional shape, whereby the tips of the horns form cutting edges each comprising two plane blade surfaces. Each two blade surfaces and the plane connecting surface positioned between said two blade surfaces form a Z-shaped broken line in the cross section of the blade. This shape of the blade provides for an easy fastening of the blade in a fastening socket by means of one of the horns of said blade.

6 Claims, 3 Drawing Figures

FIG. 1
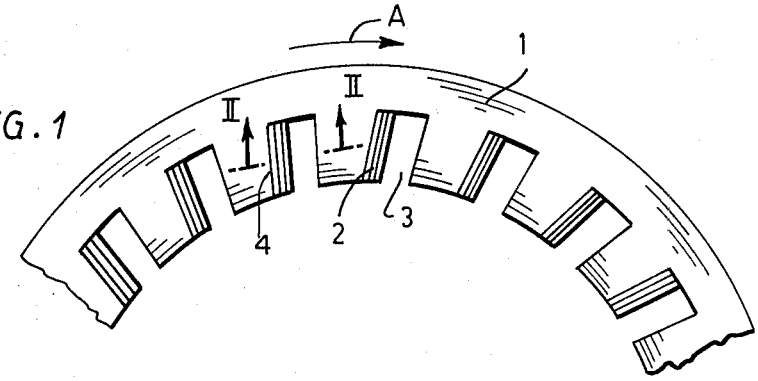
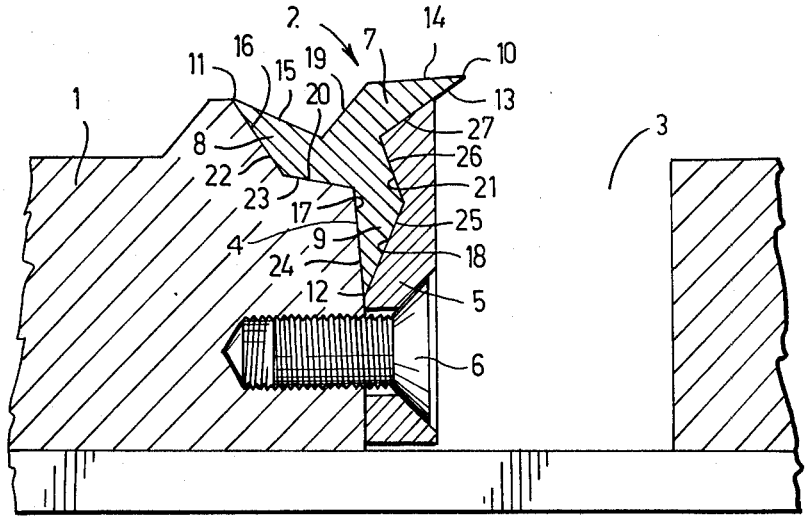
FIG. 2
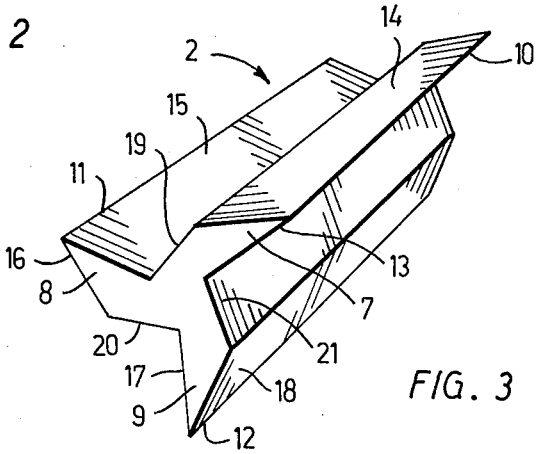
FIG. 3

BLADE FOR A CUTTER FOR A CHIPPER OR SIMILAR WOOD REDUCING MACHINE

The subject of the present invention is a blade for a cutter for a chipper or similar wood reducing machine, said cutter comprising a rotary support which is provided with fastening sockets positioned at a distance from each other in the direction of the circumference of said support and with blade holders for each blade, whereby the blade forms opposite cutting edges separated by fastening surfaces.

It has been suggested earlier to use exchangeable blades in cutters for chipper machines which blades are detachably fastened to fastening sockets formed into a rotable support, by means of particular blade holders. According to one embodiment the cross-section of the blade has the shape of parallellogram, whereby both diagonally opposite acute angle areas each form cutting edges limited by two cutting surfaces and both opposite obtuse angle areas each form two contact surfaces for fastening the blade. Thus, the blade forms two cutting edges, so that the other cutting edge can be turned to the working position after the first cutting edge has been worn. Such a blade is described in the published Finnish patent application No. 750913.

The known blade of the described type, however, involves the drawback that, when the blade is fastened in the fastening socket in the support by means of the blade holder, only the cutting edge of the blade is positioned outside the rotary support. Under these circumstances, only a relatively small portion of the surface of the blade is in contact with the surrounding air while the support rotates, which has a detrimental effect on the cooling of the blade. Since only a part of the remaining surface of the blade is in contact with the cold metal surfaces of the blade holder and of the fastening socket, the heat transfer from the blade to the holding means is also poor. Moreover, an insulating air space is formed between the blade holder and the fastening socket in the support.

It is an object of the present invention to provide a blade which eliminates the above drawbacks and which is of such a shape that the blade forms more than two cutting edges and, moreover, provides a fastening construction more favourable from the point of view of cooling. This object is achieved by means of a blade in accordance with the present invention, which is characterized in that the blade is of a three-horn cross-sectional shape resembling a star, whereby the tips of the horns form said cutting edges.

The present invention is based on the idea that a star-like shape forming at least three horns provides certain advantages from the point of view of using and fastening of the blade. The blade can be fastened into the fastening socket of the support by pressing the blade holder against one horn only, whereby at least one of the sides in each of the remaining two horns of a three-horn blade is exposed. Owing to the large exposed surface of the blade, the blade is cooled efficiently by the surrounding air when the support rotates. A large area of the blade can be pressed against the cold fastening surfaces of the fastening socket in the support and of the blade holder, so that the heat transfer from the blade is favourable. Moreover, the blade has at least two cutting edges in reserve, and the specific shape of the blade does not prevent each horn from being positioned in correct angular position with respect to the cutting process, without any disturbance of the operation of the cutting edge by the other horns.

In a blade in which each cutting edge comprises two plane blade surfaces it is advantageous that between the blade surfaces of two cutting edges there is one plane connecting surface, whereby the blade surfaces and the connecting surface form a Z-shaped broken line in the cross-section of the blade. In this way it is possible to obtain a simple fastening of the blade by means of its horn.

The invention will be described more closely below with reference to the attached drawing, wherein FIG. 1 is an axial view of a rotable support and blades of a cutter for a reducing machine, FIG. 2 is a cross-sectional view of a blade on an enlarged scale along line II—II in FIG. 1, and FIG. 3 is a perspective view of a blade.

FIG. 1 in the drawing shows a place annular support disk 1 of a cutter, which is in the present case intended to be fastened to the rotor of a barking machine so as to rotate along with the rotor around a centre axis perpendicular to the support disk. A number of blades 2 are fastened to the support disk at mutual distances in the direction of the circumference, and a chip opening 3 has been formed into the support disk in front of each blade in the direction of rotation A.

As appears best from FIG. 2, the support disk is provided for each blade with a fastening socket 4 and a blade holder 5 for fastening the blade, which holder is detachably fastened to the support disk by means of screws 6.

According to the invention, the blade 2 has a three-horn, star-shaped cross-sectional form. The blade comprises three horns 7,8,9 which are positioned symmetrically and each of which forms a cutting edge 10,11 and 12, respectively. Each cutting edge comprises two plane blade surfaces 13,14,15,16, and 17,18, respectively. Between the blade surfaces of adjoining horns there is a plane connecting surface, 19,20, and 21, respectively. The blade surfaces of adjoining horns positioned on the same side of the blade and the connecting surface between said blade surfaces form an Z-shaped broken line in the cross-section of the blade.

In particular, it appears from FIG. 2 that the blade is fastened to the fastening socket 4 in the support disk by means of a blade holder 5 so that one horn 7 of the blade points at the direction desired from the point of view of chipping. For this purpose, support surfaces 22,23 and 24 have been provided in the fastening socket and the mutual positions of said support surfaces corresponds to the Z-shaped broken line of the blade surfaces 16,20 and 17. Correspondingly, the blade holder is provided with support surfaces 25,26 and 27, the mutual positions of which correspond to the Z-shaped broken line of the blade surfaces 18,21 and 13. Since all the horns are symmetrical in relation to each other as regards their shape and position, the blade can therefore be fastened to the support disk with any one of the horns being positioned in the cutting position.

It is noticed that the blade in accordance with the invention forms three different cutting edges. The surfaces 15,19,14 and partly also the surface 13 of the blade are exposed, so that the surrounding air cools the blade efficiently when the support disk rotates. The blade surfaces 16,20,17,18,21 and partly also the surface 13 are pressed against metal surfaces, so that the heat transfer from the blade to the support disk is good. The fastening of the blade is very robust.

The drawing and the related description are only intended to illustrate the idea of the invention. In its details, the blade in accordance with the invention may show even considerable variation within the scope of the patent claims.

What I claim is:

1. A blade for a cutter for a chipper or similar wood reducing machine, the blade defining equi-angularly spaced cutting edges separated by fastening surfaces, the blade having a three-horn cross-sectional shape resembling a star with the tips of the horns each forming a said cutting edge.

2. A blade as claimed in claim 1, wherein each cutting edge is defined by two plane blade surfaces, wherein between the blade surfaces of adjacent cutting edges there is one plane connecting surface, whereby said blade surfaces and said connecting surface form a Z-shaped line in the cross-section of the blade.

3. A cutter, for a chipper or similar wood reducing machine, comprising a rotary support provided with fastening sockets positioned at equal distances in the direction of the circumference of said support and with blade holders for blades, and blades mounted on said blade holders, each blade defining equi-angularly spaced cutting edges separated by fastening surfaces, each blade having a three-horn cross-sectional shape resembling a star with the tips of the horns each forming a said cutting edge.

4. A cutter as claimed in claim 3, wherein each cutting edge is defined by two plane blade surfaces, wherein between the blade surfaces of adjacent cutting edges there is one plane connecting surface whereby said blade surfaces and said connecting surface for a Z-shaped line in the cross-section of the blade.

5. A cutter as claimed in claim 4, wherein those blade surfaces of two cutting edges which are positioned adjacent one another and the associated connecting surface bwtween said blade surfaces form counter-surfaces for support surfaces provided on the fastening socket in the rotary support and that two other blade surfaces positioned between adjacent cutting edges and their connecting surface form counter-surfaces for support surfaces provided on the blade holder.

6. A blade as claimed in claim 2, wherein the cross-section form of the blade is symmetrical.

* * * * *